United States Patent [19]

Sato

[11] Patent Number: 4,647,235

[45] Date of Patent: Mar. 3, 1987

[54] THERMAL PRINTING CASSETTE MOUNTABLE IN A THERMAL PRINTER

[75] Inventor: Yo Sato, Tokyo, Japan

[73] Assignee: Kabushiki Kaisha Sato, Japan

[21] Appl. No.: 802,034

[22] Filed: Nov. 26, 1985

[30] Foreign Application Priority Data

Nov. 29, 1984 [JP] Japan ..... 59-250541

[51] Int. Cl.[4] ..... B41J 3/00; B65H 25/00

[52] U.S. Cl. ..... 400/120; 400/88; 101/93.04; 101/288; 156/384; 156/387; 156/542

[58] Field of Search ..... 400/120, 207, 88; 101/93.04, 93.05, 67, 288, 291; 156/361, 384, 387, 542; 340/365 R

[56] References Cited

U.S. PATENT DOCUMENTS

| | | | |
|---|---|---|---|
| 3,940,758 | 2/1976 | Margolin | 340/365 R |
| 4,005,388 | 1/1977 | Morley et al. | 340/365 R |
| 4,253,774 | 3/1981 | Hanakata et al. | 400/120 X |
| 4,264,396 | 4/1981 | Stewart | 101/93.04 |
| 4,360,892 | 11/1982 | Endfield | 400/88 X |

FOREIGN PATENT DOCUMENTS

| | | | |
|---|---|---|---|
| 67280 | 6/1981 | Japan | 400/88 |
| 48206 | 6/1982 | Japan | 400/88 |
| 2077970 | 12/1981 | United Kingdom | 400/103 |

*Primary Examiner*—E. H. Eickholt

*Attorney, Agent, or Firm*—Ostrolenk, Faber, Gerb & Soffen

[57] ABSTRACT

A thermal printing cassette includes a body with a path for a strip of labels through it. A thermal printing head in the body operates against a platen to print the labels fed therepast. A feed roller moves the label strip past the platen. The labels are separated from the backing strip of the label strip at the platen to move through the cassette outlet. Data to be printed on the labels is applied at a data input and is displayed at a data display. A detector detects the labels to activate the printer to print. A unified control controls operation of all the foregoing elements. In one embodiment, the cassette is mounted to a desk type printer both electrically and mechanically. The printer includes a supply of the label strip and may include a printed label take-up, plus a power supply. In another embodiment, the printer is a portable unit to which the cassette is mounted both electrically and mechanically and which also has the label supply and a portable electric power supply.

13 Claims, 3 Drawing Figures

THERMAL PRINTING CASSETTE MOUNTABLE IN A THERMAL PRINTER

BACKGROUND OF THE INVENTION (1) Field of the Invention

The present invention relates to a thermal printing cassette and a thermal printer, and particularly, to a thermal printer that makes various modes of label printing and label applying possible through a particular printing cassette.

(2) Description of the Prior Art

Since thermal printers are small in size and light in weight, they have been used as various output means in recent years, and they have also been employed for printing price labels and tags in retail shops.

Desk type printers are convenient for printing a large number of price labels at one time, in the rear service areas of supermarkets, for example. However, such printers are inconvenient for use in shop fronts because it is difficult to carry them and move them through shops. Meanwhile, a portable thermal label printing and applying machine has been proposed, as in Japanese Patent Publication No. 58-15376 (1983), which corresponds to U.S. Pat. No. 4,264,396. This thermal printer is convenient for use in printing and applying labels at the front of the shops. However, it is inconvenient for printing a large number of labels at one time.

SUMMARY OF THE INVENTION

It is, therefore, the primary object of the present invention to provide an improved thermal printing cassette and a thermal printer which are free from the above-described disadvantages.

Another object of the present invention is to provide a thermal printing cassette and a thermal printer which facilitate additional or supplemental printing of a large number of price labels at the shop fronts.

A further object of the present invention is to provide a thermal printing cassette and a thermal printer which are capable of printing both labels and tags.

Still a further object of the present invention is to provide a thermal printing cassette and a thermal printer which are efficient in operation but simple in structure.

According to the present invention, the mechanism for printing is in the form of a thermal printing cassette. This printing cassette can be detachably mounted on the main body of either a desk type or a portable type printer, thereby making it possible to meet various conditions of printing and applying labels and tags.

The thermal printing cassette of the invention comprises a main body which includes a path for travel of heat-sensitive price labels, a printing means for printing desired characters, patterns, or the like on the price labels following a print starting signal, a data input means, a data display means, feeding means for feeding the price labels, detecting means for detecting the price labels, and controlling means for controlling each of the foregoing.

BRIEF DESCRIPTION OF THE DRAWINGS

The foregoing and other objects and features of the invention will become more apparent from the following description taken in connection with the accompanying drawings in which.

DESCRIPTION OF THE PREFERRED EMBODIMENT

Figure 1:
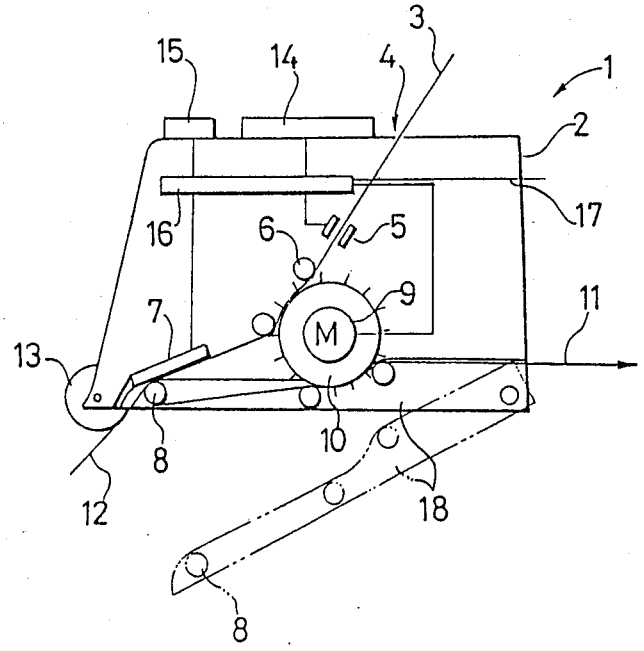
FIG. 1 is a schematic illustration of a thermal printing cassette according to the present invention.

A thermal printing cassette 1 according to the present invention, is shown in FIG. 1. A number of the means mentioned below may be of the type shown in above noted U.S. Pat. No. 4,264,396.

The cassette includes a main body. There is formed in the main body 2 of the printing cassette 1 a path 4 which is traversed by a heat-sensitive label strip 3. This path 4 includes in sequence, a label sensor 5 for sensing each label of the strip, guide rollers 6 which determine the path of the strip, a thermal head 7 for printing the labels through a thermal printing medium, a platen roller 8 against which the head 7 operates to apply printing pressure, and also a feed roller 10 bracketed by the rollers 6 and that is driven by a step-motor 9.

The label strip 3 is of a known type and includes labels 12 which are temporarily stuck to a strip of backing paper 11. The backing paper 11 is turned sharply rearwardly back on the platen 8, and it engages the underside of the feed roller 10 and then it is paid out of the rear of the main body 2. The labels 12 released from the label strip 3 at the platen are discharged beneath the underside of a label applying roller 13.

The label sensor may be like the sensing means 8 in U.S. Pat. No. 4,264,396.

A keyboard 14 which serves as a data input means and a display means 15, including a liquid crystal image screen, light emitting diode, or the like, are installed on the upper part of the main body 2. A unit like the keyboard 14 can be found in U.S. Pat. No. 4,264,396 at 18, 19. A display means like means 15 can be found in U.S. Pat. No. 4,264,396 at 35.

In the main body 2, there is a control means 16 that is electrically connected to all of the sensor 5, the thermal head 7, the step-motor 9, the keyboard 14, the display means 15 and an electrical connecting section 17 that is led to the outside. All of these connections are illustrated schematically by single lines. The control means 16 functions like means 21 in the RAM in U.S. Pat. No. 4,264,396.

The platen 8 is attached to the bottom cover 18 of the main body. When the bottom cover 18 is opened by being turned around a rear pivot, the label strip 3 can be passed along its pathway and eventually out of the main body.

Figure 2:
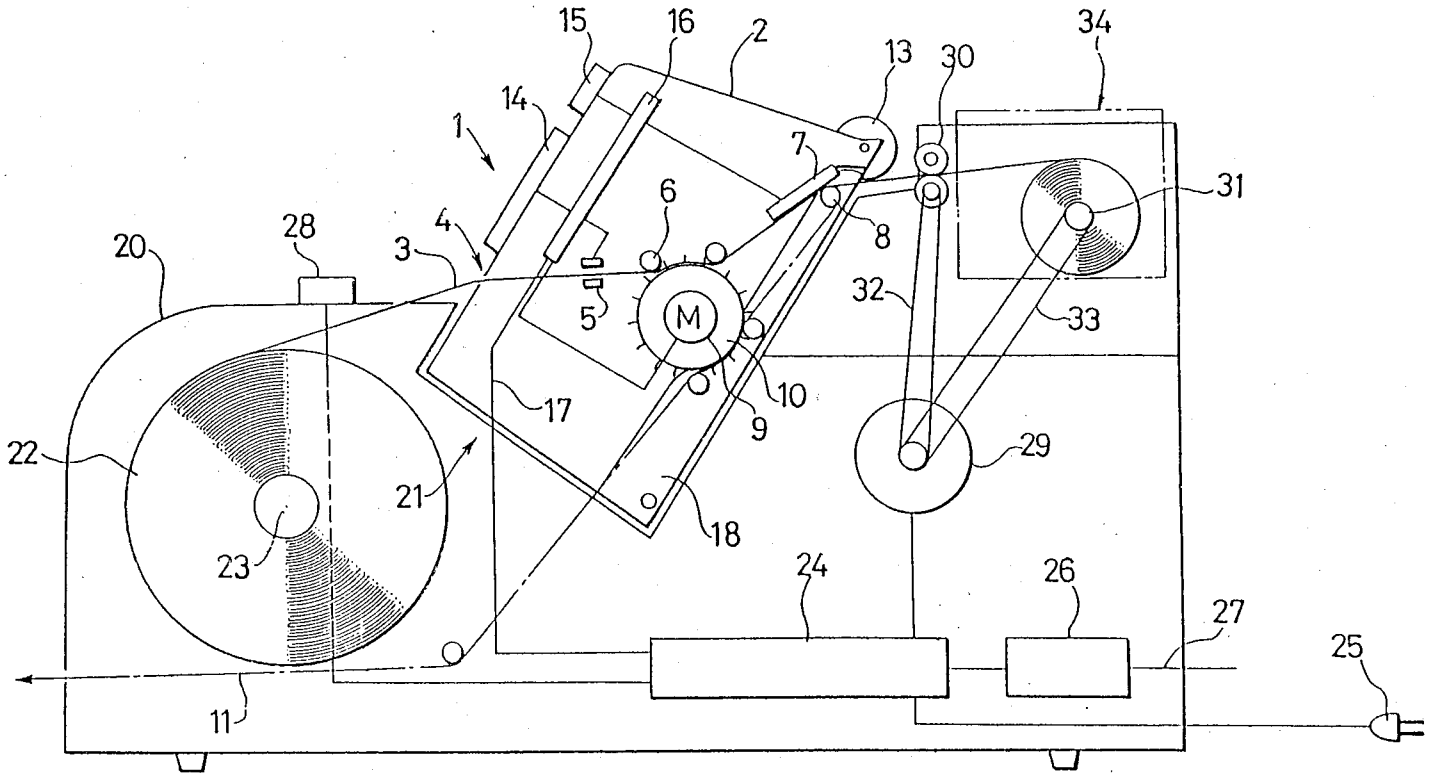
FIG. 2 is a schematic side view of a desk type printer main body on which the cassette of FIG. 1 is mounted.

FIG. 2 shows a desk type printer main body 20 on which the thermal printing cassette 1 of FIG. 1 is mounted. When the printing cassette 1 is mounted on the desk type printer main body 20, the electrical connection 21 and mechanical linkage (not shown) between the cassette and the printer are established. The main body 20 is provided with a supporting means 23 for a label strip roll 22. The control means 16, on the one hand, and a plug 25 that is connected to an AC power source, on the other hand, are joined to a main body control means 24 that is installed in the main body 20. The control means 24 also functions like means 21 in U.S. Pat. No. 4,264,396. The main body control means 24 is connected via an interface 26 to a data input port 27 that is led from the outside. The control means 24 also is connected to a switch 28 and a step-motor 29. The step-motor 29 is connected through belt 32 to a pair of delivery rollers 30 and through belt 33 to a take-up roll 31 for the printed labels.

It is possible to provide the take-up roll 31 with a different take-up cassette mechanism 34 such as those disclosed in Japanese Laid-Open Patent Publication No. 59-163139 (1984).

Just as heat-sensitive price labels can be printed, heat-sensitive tags (not shown) can also be printed. When the tags are printed, a cutting means (not shown) is provided for cutting tags at a prescribed pitch or length, which tags have been previously printed and discharged outside the cassette main body 2. Also, an arranging means (not shown) for arranging the cut tags can be provided, in place of the take-up roll 31 or the take-up cassette mechanism 34.

Figure 3:
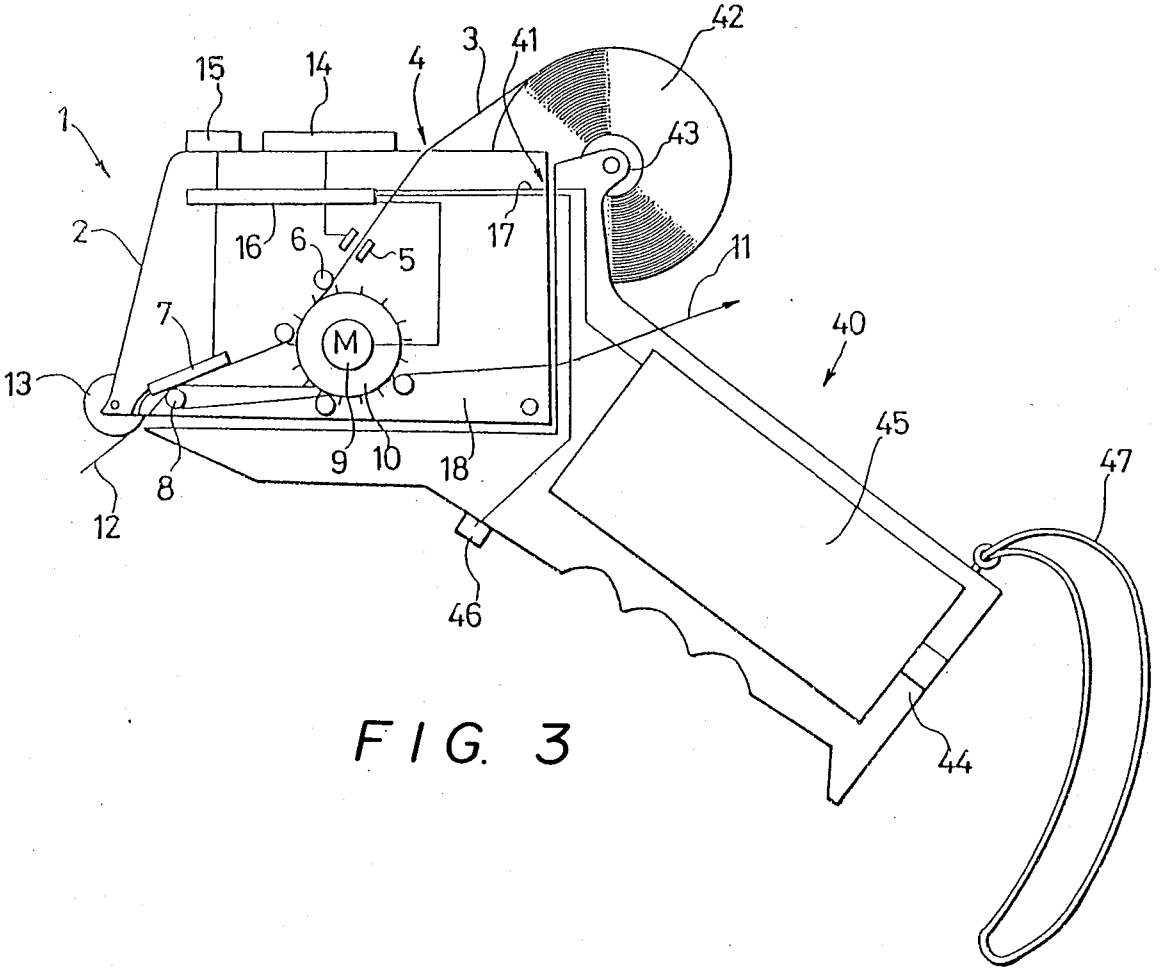
FIG. 3 is also a schematic side view of a portable printer main body on which the cassette of FIG. 1 is mounted.

FIG. 3 shows the main body 40 of a portable printer on which the above-described thermal printing cassette 1 may also be mounted. When the printing cassette 1 is mounted on the printer main body 40, the electrical connection 41 and mechanical linkage (not shown) between the cassette and the printer main body are established. The main body 40 is provided with a label supporting means 43 for supporting a label roll 42. Further, the main body 40 is provided with a switch 46 for turning on and off the label feed roller 10 and with a storage battery 45 with a connector 44. The main body 40 may also be provided with a strap 47, or the like, for facilitating carrying the main body 40.

The functions of the printer are now described.

The thermal printing cassette 1 is mounted either upon the desk type printer main body 20 or upon the portable type printer main body 40 to serve them as a thermal printer. For example, when the printing cassette 1 is set to the printer main body 20 in FIG. 2, the data inputted from the keyboard 14 are stored in a memory means in the control means 16 and the data also are displayed on the display means 15. Then when the switch 28 is turned on, the motor 9 is driven, thereby printing characters, figures, bar codes, or the like, having desired patterns by means of the thermal head 7. The printed label strip 3 is taken-up, through the delivery rollers 30, by the take-up roll 31 or by an alternate take-up cassette 34 as desired.

If it is necessary that the labels 12 first be released from the backing paper 11 before the labels are taken up, the backing paper 11 of the label strip is turned around the platen 8 to peel off the printed labels 12.

When tags are printed in place of the label strip 3, it is also possible that the tags will be engaged with the feed roller 10 and will be delivered by being pinched between the delivery rollers 30.

Data input from an external floppy disk or other data source (not shown) besides the input from the keyboard 14 can be done by way of the data input port 27 and the interface 26.

By means of the above printer, a large number of printed labels or tags can be made in a rear service area of a business establishment.

If the printing cassette 1 is set to the portable printer main body 40, as shown in FIG. 3, the motor 9 and the thermal head 7 are driven, by the input from the keyboard 14 and the switch 46, to print the labels 12. Concurrently, the labels 12 are released from the backing paper 11 and they are stuck to the surfaces of goods by applying roller 13.

Of course, if the backing paper 11 is not turned around or bent on the platen 8, the label strip 3 consists of printed labels which are still carried on the backing paper 11.

In place of the printing cassette 1, the whole body of the thermal printer shown in FIG. 3 can be detachably mounted on the printer main body 20 that is shown in FIG. 2, in a modified printer system.

As described above, according to the present invention, it is possible to make a large number of price labels or to print many labels and tags. Furthermore, additional labels can easily be made not only in rear service areas but also in shop front service areas.

Further, if printing cassettes of various types are provided, label printing and label applying work can be done simultaneously using any of various desk type printers and portable type printers.

Although the present invention has been described in connection with a plurality of preferred embodiments thereof, many other variations and modifications will become apparent to those skilled in the art. It is preferred, therefore, that the present invention be limited not by the specific disclosure herein, but only by the appended claims.

What is claimed is:

1. A thermal printing cassette comprising:

a cassette main body, and means in the main body for defining a pathway for passage of a strip of labels through the main body; heat generating printing means for printing desired characters, patterns, or the like, on the labels, the printing means being in the path through the main body for contacting the labels moving therepast; feeding means in the main body for feeding the labels along the path through the main body and past the printing means; data input means for inputting data to the printing means which data is to be thereafter printed by the printing means; a data display means connected with the data input means for displaying the inputted data; detecting means for detecting the passage of the labels through the main body along the path and for detecting the presence of individual labels; the detecting means being connected with the printing means for generating a print starting signal for initiating printing by the printing means upon a label each time a label is detected as moving past the printing means by the detecting means; and controlling means connected with each of the aforesaid means for controlling their operation and coordinating them.

2. The thermal printing cassette of claim 1, further comprising an outlet from the main body for the printed labels.

3. The thermal printing device of claim 2, further comprising applying means at the outlet for applying labels exiting through the outlet to another article.

4. The thermal printing cassette of claim 2, further comprising a platen operating in opposition to the printing means, and the path for the label strip extending between the printing means and the platen, whereby the printing means print labels on the platen.

5. The thermal printing cassette of claim 4, wherein the platen is shaped for wrapping the backing strip of the label strip around the platen for thereby causing the labels on the backing strip to separate from the backing strip at the platen, and a means for moving the backing strip away from the labels separated therefrom.

6. The thermal printing cassette of claim 5, wherein the feeding means comprise a feed roller disposed in the path through the main body and the path of the label strip being over the feeding roller for moving the label strip past the feeding roller toward the printing means; the backing strip passing the feeding means roller after the backing strip passes the platen, for thereby driving the backing strip to move.

7. The thermal printing cassette of claim 2, wherein the feeding means comprises a feed roller disposed in the path through the main body and the path of the label strip being over the feeding roller for moving the label strip past the feeding roller toward the printing means.

8. A thermal printer comprising the thermal printing cassette of claim 2 and a desk type printer, the printer including a printer body on which the thermal printing cassette is detachably mounted; the printer main body including an electrical connection to the controlling means of the cassette and including a mechanical linkage to mechanically mount the cassette to the printer body; electric power supply means at the printer body and being connected at the electrical connection to the controlling means; supporting means on the printer body for supporting the strip of labels to be fed to the feeding means of the cassette.

9. The thermal printer of claim 8, further comprising take-up means on the desk-type printer body for winding thereupon labels following the printing of and the exit of the labels from the cassette outlet.

10. A thermal printer comprising the thermal printing cassette of claim 2 and a desk type printer, including a printer body on which the thermal printing cassette is detachably mounted; the printer main body including an electrical connection to the controlling means of the cassette and including a mechanical linkage to mechanically mount the cassette to the printer body; electric power supply means at the printer body and being connected at the electrical connection to the controlling means; and take-up means on the desk-type printer body for winding thereupon labels following the printing of and the exit of the labels from the cassette outlet.

11. A thermal printer comprising the thermal printing cassette according to claim 2 and a desk type printer, including a printer body on which the thermal printing cassette is detachably mounted; the printer main body including an electrical connection to the controlling means of the cassette and including a mechanical linkage to mechanically mount the cassette to the printer body; electric power supply means at the printer body and being connected at the electrical connection to the controlling means; take-up means on the desk-type printer body for winding thereupon price labels following the printing thereof and the exit of the labels from the cassette outlet; and cutting means for cutting the label strip into individual labels following exit of labels from the outlet.

12. A thermal printer comprising the thermal printing cassette of claim 2 and a portable printer having a body, the thermal printing cassette being detachably mounted on the printer body with electrical connection thereto and with a mechanical linkage for holding the cassette to the printer body; the printer body having supporting means for supporting the strip of labels to be fed to the feeding means of the cassette; the printer having electric power supply means connected with the controlling means for supplying electrical power to the controlling means for operating the controlling means and also the other means in the cassette connected with the controlling means.

13. The thermal printer of claim 12, wherein the electric power supply means is portable and is included within the printer body.

* * * * *